US010497298B2

(12) United States Patent
Chen et al.

(10) Patent No.: US 10,497,298 B2
(45) Date of Patent: Dec. 3, 2019

(54) DISPLAY CONTROL UNIT, DISPLAY DEVICE, AND DISPLAY CONTROL METHOD

(71) Applicant: AU OPTRONICS CORPORATION, Hsin-chu (TW)

(72) Inventors: Ya-Ting Chen, Hsin-chu (TW); Hui-Feng Lin, Hsin-chu (TW); Sheng-Wen Cheng, Hsin-chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 335 days.

(21) Appl. No.: 15/412,627

(22) Filed: Jan. 23, 2017

(65) Prior Publication Data

US 2018/0053457 A1 Feb. 22, 2018

(30) Foreign Application Priority Data

Aug. 16, 2016 (TW) ..... 105126153 A

(51) Int. Cl.
*G09G 3/20* (2006.01)

(52) U.S. Cl.
CPC ..... *G09G 3/2003* (2013.01); *G09G 3/2096* (2013.01); *G09G 2310/027* (2013.01);
(Continued)

(58) Field of Classification Search
CPC .. G09G 3/2003; G09G 3/3607; G09G 3/2096; G09G 2300/0452;
(Continued)

(56) References Cited

U.S. PATENT DOCUMENTS 8,223,180 B2 7/2012 Elliott et al.
2004/0234163 A1* 11/2004 Lee ..... G06T 3/4092 382/298
(Continued)

FOREIGN PATENT DOCUMENTS

CN 101996600 A 3/2011
CN 103472608 A 12/2013
(Continued)

OTHER PUBLICATIONS

Office Action issued by (TIPO) Intellectual Property Office, Ministry of Economic Affairs, R.O.C. dated Dec. 15, 2016 for Application No. 105126153, Taiwan.
(Continued)

*Primary Examiner* — Amr A Awad
*Assistant Examiner* — Maheen I Javed
(74) *Attorney, Agent, or Firm* — Tim Tingkang Xia, Esq.; Locke Lord LLP

(57) ABSTRACT

A display control method includes splitting an image signal into a plurality of input signal sets, generating a first color reformed data, a second color reformed data, a third color reformed data and a fourth color reformed data according to each input signal set, outputting the first color reformed data, the second color reformed data and the third color reformed data when a plurality of pixels corresponding to one input signal set is located at an odd row, and outputting the second color reformed data, the third color reformed data and the fourth color reformed data when the plurality of pixels corresponding to one input signal set is located at an even row. Each input signal set includes a plurality of input signals that correspond to a plurality of adjacent pixels.

20 Claims, 4 Drawing Sheets

(52) U.S. Cl.
CPC ..... *G09G 2320/029* (2013.01); *G09G 2320/0242* (2013.01); *G09G 2320/0673* (2013.01); *G09G 2380/10* (2013.01)

(58) Field of Classification Search
CPC ... G09G 2300/0426; G09G 2320/0673; G09G 2380/10; G09G 2320/029; G09G 2310/027; G09G 2320/0242
See application file for complete search history.

(56) References Cited

U.S. PATENT DOCUMENTS

| | | | | |
|---|---|---|---|---|
| 2011/0043553 | A1* | 2/2011 | Brown Elliott ..... | G09G 3/3406 345/694 |
| 2014/0204008 | A1 | 7/2014 | Chu-Ke et al. | |
| 2015/0331291 | A1 | 11/2015 | Sakaigawa | |
| 2015/0371605 | A1* | 12/2015 | Wu ..... | G09G 5/02 345/604 |
| 2016/0196780 | A1 | 7/2016 | Chu-Ke et al. | |

FOREIGN PATENT DOCUMENTS

| | | | |
|---|---|---|---|
| TW | 201321854 | A | 6/2013 |
| TW | 201430816 | A | 8/2014 |

OTHER PUBLICATIONS

Office Action issued by the State Intellectual Property Office of the Peoples Republic of China dated Jul. 25, 2018 for Application No. CN201610930336.7.

* cited by examiner

DISPLAY CONTROL UNIT, DISPLAY DEVICE, AND DISPLAY CONTROL METHOD

CROSS-REFERENCE TO RELATED PATENT APPLICATION

This application claims the benefit of priority to Taiwan Patent Application No. 105126153, filed Aug. 16, 2016. The entire content of the above identified application is incorporated herein by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD

The present invention relates to display technologies, and in particular, to a display control unit, a display device, and a display control method.

BACKGROUND

With the progress and development of science and technology, a liquid crystal display is widely applied to various information display devices because of aspects such as a thin and light design and low power consumption. In various applications, the liquid crystal display may be divided into a direct-viewing-type pattern, for example, when the liquid crystal display is applied to a mobile phone or a tablet computer, a user can directly view image information displayed on the liquid crystal display, and a projection-type pattern, for example, when the liquid crystal display is applied to a vehicle head up display (head up display, HUD), driving image information displayed on the liquid crystal display is displayed on a windshield of an automobile projectively.

In the head up display of the projection-type pattern, the head up display mostly uses a thin film transistor liquid crystal display as an image source, and guides a light path by using an optical system design so that the light path is imaged on the windshield. Generally, to acquire a clear projection image on the windshield, the liquid crystal display of the head up display generally needs high backlight luminance to withstand effects of ambient light. Therefore, later people add a white sub-pixel (W) into a conventional RGB liquid crystal display (the liquid crystal display may be called an RGBW liquid crystal display later), so that a needed backlight luminance is reduced by improving the penetration rate of the liquid crystal display.

However, although the design of the RGBW liquid crystal display into which the white sub-pixel (W) is added can greatly improve the penetration rate, the areas of pure-color (that is, red, green, and blue) sub-pixels are reduced, consequently, the pure-color luminance becomes lower, and the white luminance is too high, further leading to the deteriorated image quality.

SUMMARY

On that account, the present invention provides a display control unit, a display device, and a display control method, so that a penetration rate of a display panel is improved without affecting the image quality.

In an embodiment, a display control unit includes a signal splitter, a signal processor, and a signal configurator. The signal splitter is used to split an image signal into a plurality of input signal sets. Each input signal set includes a plurality of input signals that correspond to a plurality of adjacent pixels, and each of the input signals includes a first color initial data, a second color initial data, and a third color initial data. The signal processor is used to generate a first color reformed data, a second color reformed data, a third color reformed data, and a fourth color reformed data respectively according to each input signal set. The signal configurator is used to selectively output the first color reformed data, the second color reformed data, the third color reformed data, and the fourth color reformed data corresponding to each input signal set according to locations of the plurality of pixels corresponding to each input signal set. The signal configurator outputs the first color reformed data, the second color reformed data, and the third color reformed data when the plurality of pixels corresponding to the input signal set is located at an odd row. The signal configurator outputs the second color reformed data, the third color reformed data, and the fourth color reformed data when the locations of the plurality of pixels corresponding to the input signal set is located at an even row.

In an embodiment, a display device includes a display panel, a display control unit, and a display drive unit. The display panel includes a plurality of pixel units arranged in a matrix. Each pixel unit is formed by a plurality of adjacent pixels that are in a same row, and each pixel unit includes a first sub-pixel, a second sub-pixel, and a third sub-pixel. The first sub-pixel in an odd row is used to display a first color having a corresponding grayscale, and the first sub-pixel in an even row is used to display a fourth color having a corresponding grayscale. The second sub-pixel is used to display a second color having a corresponding grayscale, and the third sub-pixel is used to display a third color having a corresponding grayscale. The first sub-pixel of the pixel units in the odd row and the first sub-pixel of the pixel units in the adjacent odd row are set diagonally. The display control unit is used to respectively generate a first color reformed data, a second color reformed data, a third color reformed data, and a fourth color reformed data corresponding to the pixel unit according to a plurality of input signals, which corresponds to the plurality of pixels in each pixel unit, in an image signal. The display drive unit is used to drive the first sub-pixel according to the first color reformed data corresponding to each pixel unit in the odd row, drive the second sub-pixel according to the second color reformed data corresponding to each pixel unit, drive the third sub-pixel according to the third color reformed data corresponding to each pixel unit, and drive the first sub-pixel according to the fourth color reformed data corresponding to each pixel unit in the even row.

In an embodiment, a display control method includes splitting an image signal into a plurality of input signal sets, generating a first color reformed data, a second color reformed data, a third color reformed data, and a fourth color reformed data respectively according to each input signal set; and selectively outputting the first color reformed data, the second color reformed data, the third color reformed data, and the fourth color reformed data corresponding to each input signal set according to locations of the plurality of pixels corresponding to each input signal set. Outputting the first color reformed data, the second color reformed data, and the third color reformed data when the plurality of pixels corresponding to the input signal set is located at an odd row. Outputting the second color reformed data, the third color reformed data, and the fourth color reformed data when the plurality of pixels corresponding to the input signal set is located at an even row. Each input signal set includes a plurality of input signals that correspond to a plurality of adjacent pixels, and each of the input signals includes a first color initial data, a second color initial data, and a third color initial data.

Based on the above, by means of the display control unit, the display device, and the display control method of the embodiments of the present invention, corresponding four color reformed data are generated by using a plurality of pixels as a pixel unit, and then the four color reformed data are selectively output according to whether each pixel unit is located at an odd row or an even row. In particular, a first sub-pixel of the pixel unit located at the odd row displays a first color; a first sub-pixel of the pixel unit located at the even row displays a fourth color, and the first sub-pixel of the pixel unit located at the odd row and the first sub-pixel of the pixel unit located at the adjacent even row are set diagonally. In this way, the display control unit, the display device, and the display control method of the embodiments of the present invention can improve the penetrate rate of the display panel and improve the pure-color luminance.

Detailed features and advantages of the present invention are described in detail below in implementation manners, and content thereof can sufficiently enable any person skilled in the art to learn technical content of the present invention and implement the present invention according to the technical content of the present invention, and according to content disclosed in the present specification, the claims, and drawings, any person skilled in the art can easily understand relevant objectives and advantages of the present invention.

DETAILED DESCRIPTION

Figure 1:
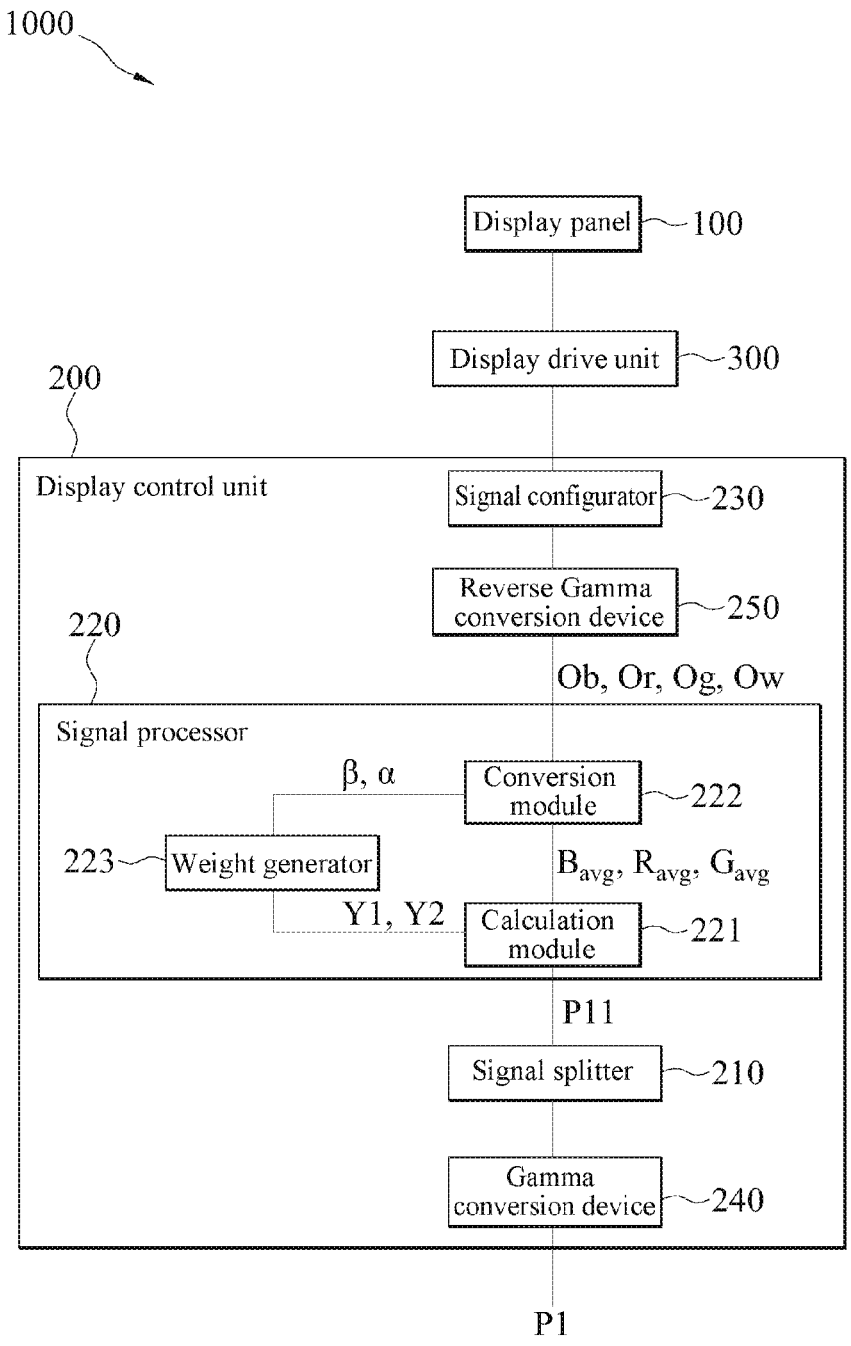
FIG. 1 is a schematic block diagram of a display device of an embodiment of the present invention.

FIG. 1 is a schematic block diagram of a display device of an embodiment of the present invention. Referring to FIG. 1, a display device 1000 includes a display panel 100, a display control unit 200, and a display drive unit 300. The display drive unit 300 is coupled to the display control unit 200 and the display panel 100.

In some embodiments, the display panel 100 may be a liquid crystal display (LCD), and the display drive unit 300 may be formed by a plurality of thin film transistors (TFT), but the present invention is not limited thereto. The display panel 100 may also be an organic electroluminescence display panel, such as an OLED display panel, and the display drive unit 300 may be formed by a plurality of thin film transistors and capacitors.

Figure 2:
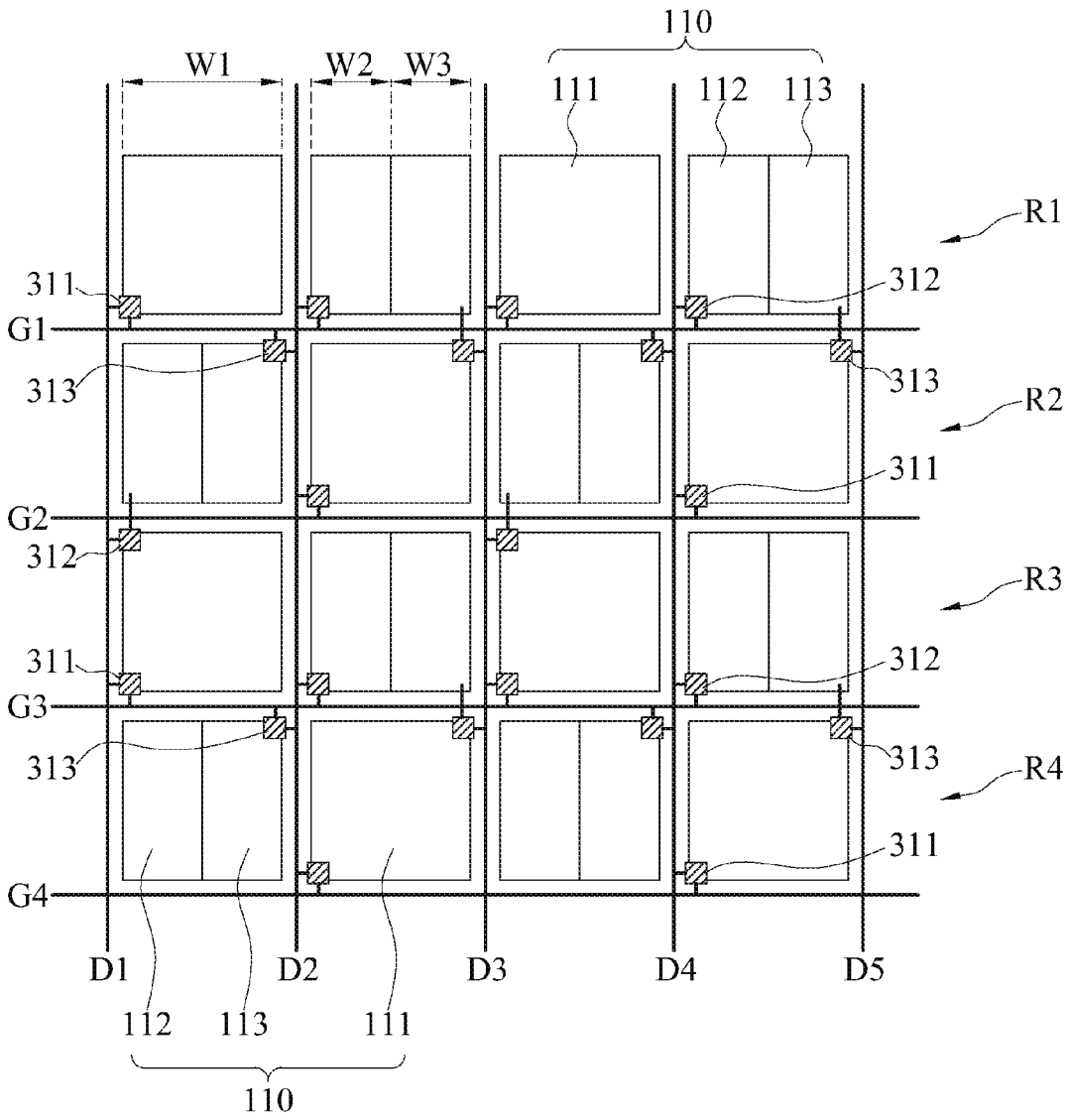
FIG. 2 is a schematic top view of a display panel of an embodiment of the present invention.

FIG. 2 is a schematic top view of a display panel of an embodiment of the present invention. Referring to FIG. 1 and FIG. 2, the display panel 100 includes a plurality of pixel units 110, and the display panel 100 is formed by arranging the pixels units 110 in a form of a matrix. Each pixel unit 110 is formed by a plurality of pixels that are in a same row. Herein, the plurality of pixels includes three sub-pixels (respectively called a first sub-pixel 111, a second sub-pixel 112, and a third pixel 113 below) for displaying different colors.

Description is provided below by using the display panel 100 formed by arranging eight pixel units 110 in an array as an example, but the present invention is not limited thereto. Herein, the display panel 100 may be divided into four rows (respectively call a first row R1, a second row R2, a third row R3, and a fourth row R4 below), and each row includes two pixel units 110.

The first sub-pixel 111 of each pixel unit 110 in an odd row may be in a diagonal relationship with the first sub-pixel 111 of the adjacent pixel unit 110 in an even row. Herein, each first sub-pixel 111 located at the first row R1 and the adjacent first sub-pixel 111 in the second row R2 are set diagonally, and each first sub-pixel 111 located at the third row R3 is set diagonally relative to both the adjacent first sub-pixel in the second row R2 and the adjacent first sub-pixel 111 in the fourth row R4.

The second sub-pixel 112 is adjacent to the third sub-pixel 113 in each pixel unit 110. The second sub-pixel 112 and the third sub-pixel 113 in each pixel unit 110 are set diagonally relative to the second sub-pixel 112 and the third sub-pixel 113 in the adjacent pixel unit 110 located at a different row.

In an embodiment, the second sub-pixel 112 in each pixel unit 110 in an odd row (that is, the row R1 and the row R3) is located between the first sub-pixel 111 and the second sub-pixel 113 of the pixel unit 110, and the third sub-pixel 113 in each pixel unit 110 in an even row (that is, the row R2 and the row R4) is located between the first sub-pixel 111 and the second sub-pixel 112 of the pixel unit 110, but the present invention is not limited thereto.

In another embodiment (not shown), the third sub-pixel 113 in each pixel unit 110 in an odd row is located between the first sub-pixel 111 and the second sub-pixel 112 of the pixel unit 110, and the second sub-pixel 112 in each pixel unit 110 in an even row is located between the first sub-pixel 111 and the third pixel 113 of the pixel unit 110.

In an embodiment, in each pixel unit 110, the second sub-pixel 112 is located between the first sub-pixel 111 and the third sub-pixel 113. In other words, the first sub-pixel 111, the second sub-pixel 112, and the third sub-pixel 113 of each pixel unit 110 are configured according to the sequence of the first sub-pixel 111, the second sub-pixel 112, and the third sub-pixel 113. However, the present invention is not limited thereto. In another embodiment (not shown), in each pixel unit 110, the third sub-pixel 113 is located between the first sub-pixel 111 and the second sub-pixel 112. In other words, the first sub-pixel 111, the second sub-pixel 112, and the third sub-pixel 113 of each pixel unit 110 are configured according to the sequence of the first sub-pixel 111, the third sub-pixel 113, and the second sub-pixel 112.

In some embodiments, a light-emitting area of the first sub-pixel 111 is approximately twice that of the second sub-pixel 112, and the light-emitting area of the second sub-pixel 112 is approximately same as that of the third sub-pixel 113. For example, a width W1 of the light-emitting area of the first sub-pixel 111 is approximately twice a width W2 of the light-emitting area of the second sub-pixel 112, and a length of the light-emitting area of the first sub-pixel 111 is approximately same as that of the second sub-pixel 112, so that the light-emitting area of the first sub-pixel 111 is approximately twice that of the second sub-pixel 112. However, the width W2 of the light-emitting area of the second sub-pixel 112 is approximately same as a width W3 of the light-emitting area of the third sub-pixel 113, and the length of the light-emitting area of the second sub-pixel 112 is approximately same as that of the third sub-pixel 113, so that the light-emitting area of the second sub-pixel 112 is same as that of the third sub-pixel 113. Using that each pixel unit 110 has two pixels as an example, one pixel is formed by the first sub-pixel 111, and the other pixel is formed by the second sub-pixel 112 and the third sub-pixel 113.

In some embodiments, the first sub-pixel 111 in each pixel unit 110 in an odd row can be used to display a first color having a corresponding grayscale, and the first sub-pixel 111 in each pixel unit 110 in an even row can be used to display a fourth color having a corresponding grayscale. The second sub-pixel 112 in each pixel unit 110 can be used to display a second color having a corresponding grayscale, and the third sub-pixel 113 in each pixel unit 110 can be used to display a third color having a corresponding grayscale.

In some embodiments, the first color may be blue; the second color may be red; the third color may be green; and the fourth color may be white. For example, in an application of a vehicle head up display (head up display, HUD) for reminding a driver of driving image information such as a speed per hour, a road condition, and a remaining oil volume, because the driving image information is mostly formed by red and yellow, and the driving image information that uses blue is comparatively less, the first sub-pixel 111 in an odd row may be configured to display blue that is less frequently used in the driving image information, and the first sub-pixel 111 in an odd row is configured to display white. In this way, a penetration rate of the display panel 100 can be improved by means of the configured white; further, the penetration rate of the display panel 100 may be improved again by means of improvement of a pixel aperture ratio of the first sub-pixel 111. However, the present invention is not limited thereto. In other words, the first color may be the one with comparatively least image information in blue, red, and green, and the second color and the third color are the other two colors respectively. The fourth color is white.

The display control unit 200 may respectively generate a first color reformed data Ob, a second color reformed data Or, a third color reformed data Og, and a fourth color reformed color Ow corresponding to each pixel unit 110 for a plurality of input signals in an image signal P1 in each pixel unit 110.

In an implementation aspect, the display control unit 200 may include a signal splitter 210, a signal processor 220, and a signal configurator 230. The signal processor 220 is coupled to the signal splitter 210 and the signal configurator 230, and the signal configurator 230 is coupled to the display drive unit 300.

Figure 3:
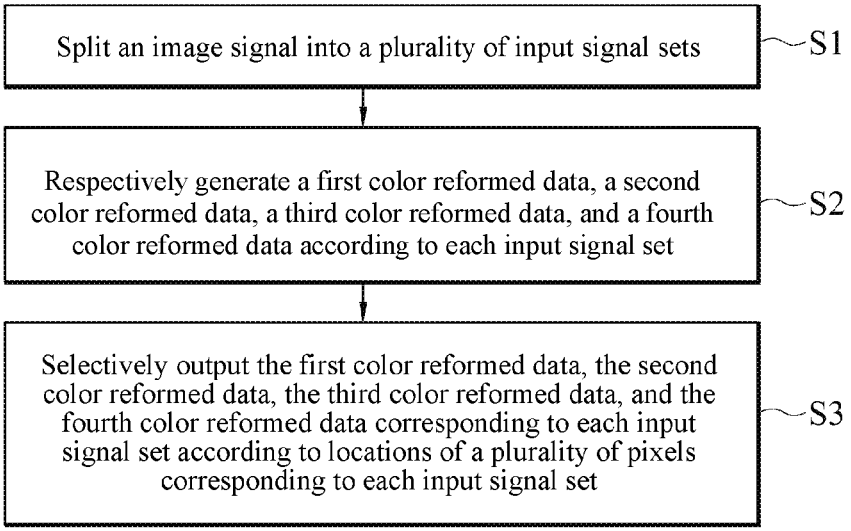
FIG. 3 is a schematic flowchart of a display control method of an embodiment of the present invention.

FIG. 3 is a schematic flowchart of a display control method of an embodiment of the present invention. Referring to FIG. 1 to FIG. 3, the signal splitter 210 may split the image signal P1 into a plurality of input signal sets P11 according to pixel locations of the pixel units 110 in the display panel 100 (step S1), and each input signal set P11 may include a plurality of input signals. Using that each pixel unit 110 has two pixels as an example, each input signal set P11 includes two input signals, and the two input signals respectively correspond to the two pixels of one pixel unit 110. In other words, the signal splitter 210 groups the image signal P1 according to the pixel locations, so as to sequentially group two input signals individually corresponding to every two adjacent pixels in each row of pixels into an input signal set P11.

Herein, each input signal includes a first color initial data, a second color initial data, and a third color initial data. The first color initial data may be used to indicate luminance of a first color covered by the input signal; the second color initial data may be used to indicate luminance of a second color covered by the input signal; and the third color initial data may be used to indicate luminance of a third color covered by the input signal.

The signal processor 220 respectively generates the first color reformed data Ob, the second color reformed data Or, the third color reformed data Og, and the fourth color reformed data Ow according to each input signal set P11 (step S2). In other words, the signal processor 220 sequentially operates each input signal set P11 to convert each input signal set P11 into a reformed data set formed by the first color reformed data Ob, the second color reformed data Or, the third color reformed data Og, and the fourth color reformed data Ow.

Figure 4:
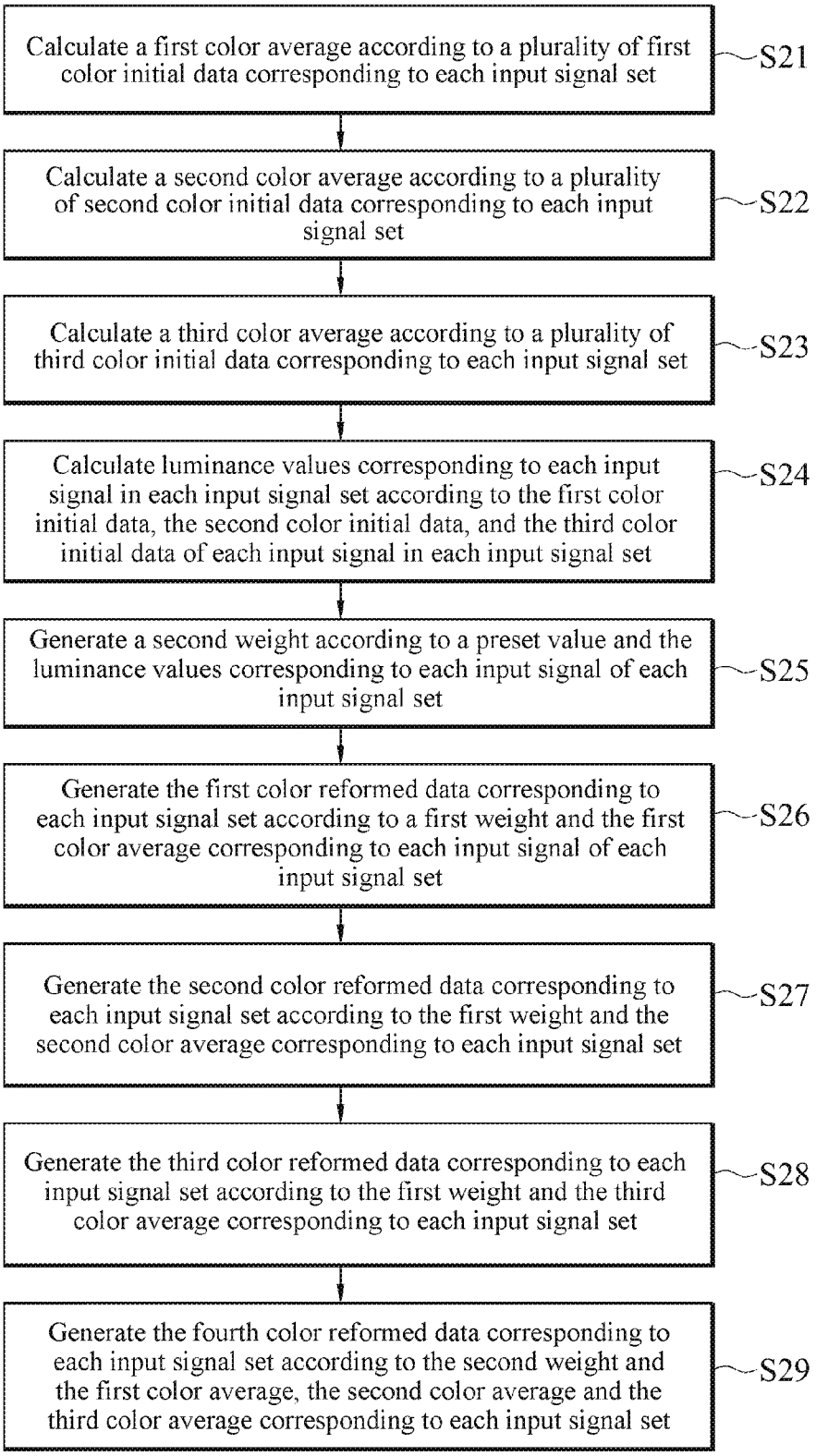
FIG. 4 is a schematic flowchart of an embodiment of step S2 in FIG. 3.

FIG. 4 is a schematic flowchart of an embodiment of step S2 in FIG. 3. Referring to FIG. 1 to FIG. 4, in an implementation pattern, the signal processor 220 includes a calculation module 221 and a calculation module 222. The calculation module 221 is coupled to the signal splitter 210 and the conversion module 222, and the conversion module 222 is coupled to the signal configurator 230.

The calculation module 221 is used to calculate a first color average $B_{avg}$ according to a plurality of first color initial data corresponding to each input signal set P11 (step S21), calculate a second color average $R_{avg}$ according to a plurality of second color initial data corresponding to each input signal set P11 (step S22), and calculate a third color average $G_{avg}$ according to a plurality of third color initial data corresponding to each input signal set P11 (step S23). Using that an input signal set P11 has two input signals (respectively called a first input signal and a second input signal) as an example, when performing operation on the input signal set P11, the calculation module 221 calculates an average between the first color initial data of the first input signal and the first initial data of the second input signal to obtain the first color average $B_{avg}$, calculates an average between the second color initial data of the first input signal and the second initial data of the second input signal to obtain the second color average $R_{avg}$, and calculates an average between the third color initial data of the first input signal and the third initial data of the second input signal to obtain the first color average $G_{avg}$.

Herein, the calculation module 221 performs average calculation on the first color initial data of all input signals in each input signal set P11 to generate the first color average $B_{avg}$, performs average calculation on the second color initial data of all input signals in each input signal set P11 to generate the second color average $R_{avg}$, and performs average calculation on the third color initial data of all input signals in each input signal set P11 to generate the third color average $G_{avg}$. The first color average $B_{avg}$ represents a luminance average of first colors included in the input signal set P11; the second color average $R_{avg}$ represents a luminance average of second colors included in the input signal set P11; and the third color average $G_{avg}$ represents a luminance average of third colors included in the input signal set P11.

In addition, the calculation module 221 may further calculate luminance values Y1 and Y2 corresponding to each input signal in the input signal set P11 according to the first color initial data, the second color initial data, and the third color initial data of each input signal in each input signal set P11 (step S24). Herein, the luminance values Y1 and Y2 are used to indicate luminance averages of corresponding inputs signals respectively. Using that an input signal set P11 has two input signals (called the first input signal and the second input signal respectively) as an example, when performing operation on the input signal set P11, the calculation module 221 calculates the luminance value Y1 according to the first color initial data, the second color initial data, and the third color initial data of the first input signal, and calculates the luminance value Y2 according to the first color initial data, the second color initial data, and the third color initial data of the second input signal.

In some embodiments, the calculation module 221 calculates the luminance values Y1 and Y2 by using a luminance conversion formula. In some embodiments, the luminance conversion formula may be the following formula 1.

$$Y=0.3*R+0.6*G+0.1*B \quad \text{formula 1}$$

where Y represents the luminance value; B represents the first color initial data; R represents the second color initial data; and G represents the third color initial data. In should be noted that the luminance conversion formula used by the calculation module 221 is not limited to the foregoing formula, and parameters multiplied by each color average can be adjusted according to situations.

For example, suppose that an input signal set P11 includes a first input signal and a second input signal. A first color initial data, a second color initial data, and a third color initial data of the first input signal are [255, 255, 255], and the first color initial data, the second color initial data, and the third color initial data of the second input signal are [0, 0, 0]. In this case, the calculation module 221 can calculate the first color average $B_{avg}$ as 0.5, calculate the second color average $R_{avg}$ as 0.5, and calculate the third color average $G_{avg}$ as 0.5. In addition, the calculation module 221 can calculate the luminance value Y1 corresponding to the first input signal as 1 and calculate the luminance value Y2 corresponding to the second input signal as 0 according to the preset luminance conversion formula (for example, the foregoing formula 1).

Although the foregoing content is narrated in the sequence of step S21 to step S24, the present invention is not limited to the execution sequence. A person skilled in the art should know that in reasonable cases, some steps may be performed synchronously or the execution sequence may be exchanged. For example, the execution sequence of step S21 to step S24 may be arbitrarily adjusted, and even any two, any three, or all of step S21 to step S24 can be executed synchronously.

Next, the conversion module 222 can convert out the first color reformed data Ob, the second color reformed data Or, the third color reformed data Og, and the fourth color reformed data Ow corresponding to each input signal set P11 according to a first weight β, a second weight α, and the first color average $B_{avg}$, the second color average $R_{avg}$, and the third color average $G_{avg}$ corresponding to each input signal set P11.

The second weight α may be used to adjust luminance of white to prevent the luminance of white from being too high. In an embodiment, the second weight α may be preset fixed value, for example: 0.5 or 0.75, but the present invention is not limited thereto. In another embodiment, the second weight α may be calculated according to the luminance values Y1 and Y2. In an implementation pattern, the second weight α may be calculated by using the following formula 2.

$$\alpha=a+b*\mathrm{Max}[Y1,Y2] \quad \text{formula 2}$$

where a and b are constants, and Max[Y1, Y2] is the maximum value of the luminance values Y1 and Y2. Herein, a and b may be a same value or different values.

In an embodiment, the first weight β may be used to adjust pure-color luminance, so that the pure-color (that is, red, green and blue) luminance of the display panel 100 of the embodiments of the present invention can be same as that of a conventional RGB display panel. The first weight β may be a preset fixed value, for example, 1, 1.125, or 1.25, but the present invention is not limited thereto.

In an implementation aspect, when the second weight α is calculated according to the luminance values Y1 and Y2, the signal processor 220 may further include a weight generator 223. The weight generator 223 is coupled to the calculation module 221 and the conversion module 222, and can be used to generate the second weight α.

Herein, the weight generator 223 may generate the second weight α according to a preset value and the luminance values Y1 and Y2 corresponding to each input signal of each input signal set P11 (step S25). Herein, the preset value may be a fixed value.

In an embodiment of step S25, the weight generator 223 may generate the second weight α by using the maximum value of the luminance value Y1 and the luminance value Y2 corresponding to each input signal in each input signal set P11 and a preset value. In an embodiment, the weight generator 223 may generate the second weight α by using the following formula 3. That is, in formula 2, a=0.5, and b=0.5.

$$\alpha=0.5+0.5*\mathrm{Max}[Y1,Y2] \quad \text{formula 3}$$

In some embodiments, the conversion module 222 may generate the first color reformed data Ob corresponding to each input signal set P11 according to the first weight β and the first color average $B_{avg}$ corresponding to each input signal of each input signal set P11 (step S26), generate the second color reformed data Or corresponding to each input signal set P11 according to the first weight β and the second color average $R_{avg}$ corresponding to each input signal of each input signal set P11 (step S27), generate the third color reformed data Og corresponding to each input signal set P11 according to the first weight β and the third color average $G_{avg}$ corresponding to each input signal of each input signal set P11 (step S28), and generate the fourth color reformed data Ow corresponding to each input signal set P11 according to the second weight α and the first color average $B_{avg}$, the second color average $R_{avg}$ and the third color average $G_{avg}$ corresponding to each input signal of each input signal set P11 (step S29).

In an embodiment of step S29, the conversion module 222 generates the fourth color reformed data Ow by using the minimum value of the first color average $B_{avg}$, the second color average $R_{avg}$ and the third color average $G_{avg}$ and the second weight α.

In some embodiments, the conversion module 222 generates the first color reformed data Ob, the second color reformed data Or, the third color reformed data Og, and the fourth color reformed data Ow by using the following formula 4 to formula 7 respectively.

$$Ob=\beta*B_{avg} \quad \text{formula 4}$$

$$Or=\beta*R_{avg} \quad \text{formula 5}$$

$$Og=\beta*G_{avg} \quad \text{formula 6}$$

$$Ow=\alpha*\min[B_{avg},R_{avg},G_{avg}] \quad \text{formula 7}$$

where Ob is the first color reformed data; Or is the second color reformed data; Og is the third color reformed data; Ow is the fourth color reformed data; β is the first weight; α is the second weight; $B_{avg}$ is the first color average; $R_{avg}$ is the second color average; and $G_{avg}$ is the third color average.

For example, suppose that the first $B_{avg}$ is 0.5, the second color average $R_{avg}$ is 0.5, the third color average $G_{avg}$ is 0.5, the luminance value Y1 is 1, the luminance value Y2 is 0, the first weight β is 1, and the second weight α is generated by using the foregoing formula 3. In this case, the second weight α output by the weight generator 223 is 1. However, the first color reformed data Ob, the second color reformed data Or, the third color reformed data Og, and the fourth color reformed data Ow generated by the conversion module 222 by using the foregoing formula 4 to formula 7 are [187, 187, 187, 187].

However, the present invention is not limited thereto. In another embodiment of step S29, the conversion module 222 may generate the fourth color reformed data Ow by using the maximum value of the first color average $B_{avg}$, the second color average $R_{avg}$ and the third color average $G_{avg}$ and the second weight α. For example, the conversion module 222 may generate the fourth color reformed data Ow by using the following formula 8.

$$Ow=\alpha*\mathrm{Max}[B_{avg},R_{avg},G_{avg}] \quad \text{formula 8}$$

where Ow is the fourth color reformed data; α is the second weight; $B_{avg}$ is the first color average; $R_{avg}$ is the second color average; and $G_{avg}$ is the third color average.

In an implementation aspect, the weight generator 223 may generate the second weight α by using the maximum value of the luminance value Y1 and the luminance value Y2 of each input signal set P11 and a preset value, and generate the fourth color reformed data Ow by using the minimum value of the first color average $B_{avg}$, the second color average $R_{avg}$, and the third color average $G_{avg}$ and the second weight α in cooperation with the conversion module 222. In this way, when the display panel 100 displays an image, an excessive difference between white luminance and the pure-color luminance is avoided, so that the good image quality can be obtained.

In some embodiments, the display control unit 200 may further include a storage unit (not shown). The storage unit may be used to store and display programs, parameters, data, and the like needed in an operation process and temporarily store parameters, data, and the like generated in the operation process. For example, the foregoing first weight β, second weight α, preset value, first color average $B_{avg}$, second color average $R_{avg}$, third color average $G_{avg}$, and the like may be stored in the storage unit. In addition, the storage unit may be built in the display control unit 200, or provided outside the display control unit 200.

Finally, the signal configurator 230 of the display control unit 200 is used to selectively output the first color reformed data Ob, the second color reformed data Or, the third color reformed data Og, and the fourth color reformed data Ow corresponding to each input signal set P11 according to locations of a plurality of pixels corresponding to each input signal set P11 (step S3), so as to control display of the corresponding pixel units 110.

When the pixel unit 110 corresponding to the input signal set P11 is located at an odd row, the signal configurator 230 may output the first color reformed data Ob so that the first sub-pixel 111 of the pixel unit 110 displays a first color having a corresponding grayscale according to the first color reformed data Ob, output the second color reformed data Or so that the second sub-pixel 112 of the pixel unit 110 displays a second color having a corresponding grayscale according to the second color reformed data Or, and output the third color reformed data Og so that the third sub-pixel 113 of the pixel unit 110 displays a third color having a corresponding grayscale according to the third color reformed data Og. Herein, because there is no sub-pixel for displaying a fourth color W in the pixel unit 110 located at the odd row, the signal configurator 230 does not output the fourth color reformed data Ow.

However, when the pixel unit 110 corresponding to the input signal set P11 is located at an even row, the signal configurator 230 may output the second color reformed data Or so that the second sub-pixel 112 of the pixel unit 110 displays the second color having the corresponding grayscale according to the second color reformed data Or, output the third color reformed data Og so that the third sub-pixel 113 of the pixel unit 110 displays the third color having the corresponding grayscale according to the third color reformed data Og, and output the fourth color reformed data Ow so that the first sub-pixel 111 of the pixel unit 110 displays the fourth color having the corresponding grayscale according to the fourth color reformed data Ow. Herein, because there is no sub-pixel for displaying the first color in the pixel unit 110 located at the even row, the signal configurator 230 does not output the first color reformed data Ob.

In some embodiments, the display control unit 200 may further include a Gamma conversion device 240, which is coupled to the signal splitter 210. The Gamma conversion device 240 is used to receive the image signal P1 output from outside, and performs Gamma conversion on the image signal P1, so that a signal output by the Gamma conversion device 240 (the converted image signal P1) may have Gamma attributes. In other words, the image signal P1 output from outside may first perform nonlinear operation by using the Gamma conversion device 240 to be converted into the image signal P1 having Gamma attributes, and then is output to the signal splitter 210 for signal splitting. In an implementation pattern, the Gamma conversion device 240 converts the image signal P1 output from outside into the image signal P1 having a corresponding Gamma value (that is, grayscale) by using a preset Gamma mapping table by means of table lookup.

In this case, the display control unit 200 may further include a reverse Gamma conversion device 250, which is coupled between the signal configurator 230 and the conversion module 222. The reverse Gamma conversion device 250 receives the first color reformed data Ob, the second color reformed data Or, the third color reformed data Og, and the fourth color reformed data Ow, and performs reverse Gamma conversion thereon. In other words, the reverse Gamma conversion device 250 may perform nonlinear reverse operation on the first color reformed data Ob, the second color reformed data Or, the third color reformed data Og, and the fourth color reformed data Ow, and then output the converted first color reformed data Ob, second color reformed data Or, third color reformed data Og, and fourth color reformed data Ow to the signal configurator 230 for configuration. In an implementation pattern, the reverse Gamma conversion device 250 performs reverse Gamma conversion on the first color reformed data Ob, the second color reformed data Or, the third color reformed data Og, and the fourth color reformed data Ow by using a preset reverse Gamma mapping table by means of table lookup.

In some embodiments, the signal configurator 230 of the display control unit 200 is coupled to the display drive unit 300. The display drive unit 300 may include a plurality of active elements 311, 312, and 313. Herein, the active elements 311, 312, and 313 are respectively coupled to the corresponding first sub-pixel 111, second sub-pixel 112, or third sub-pixel 113 in the pixel unit 110, and are respectively used to drive, according to the first color reformed data Ob, the second color reformed data Or, the third color reformed data Og, or the fourth color reformed data Ow output by the signal configurator 230, the corresponding first sub-pixel 111, second sub-pixel 112, or third sub-pixel 113 for display.

In addition, the display drive unit 300 further includes a plurality of scan lines G1 to G4 and a plurality of data lines D1 to D5. It should be noted that the drawn four scan lines G1 to G4 and five data lines D1 to D5 are only used as examples, and are not used to limit the number thereof. The active elements 311, 312, and 313 are coupled to the corresponding scan lines G1 to G4 and the corresponding data lines D1 to D5. Herein, the active elements 311, 312, and 313 receive the corresponding first color reformed data Ob, second color reformed data Or, third color reformed data Og, or fourth color reformed data Ow by using the corresponding data lines D1 to D5.

In some embodiments, the active element 311 corresponding to the first sub-pixel 111 of the pixel unit 110 located at an odd row drives the first sub-pixel 111 according to the corresponding first color reformed data Ob. The active element 312 corresponding to the second sub-pixel 112 of the pixel unit 110 drives the second sub-pixel 112 according to the corresponding second color reformed data Or. The active element 313 corresponding to the third sub-pixel 113 of the pixel unit 110 drives the third sub-pixel 113 according to the corresponding third color reformed data Og. In addition, the active element 311 corresponding to the first sub-pixel 111 of the pixel unit 110 located at an even row drives the first sub-pixel 111 according to the corresponding fourth color reformed data Ow.

In some embodiments, one of the active element 312 of the second sub-pixel 112 and the active element 313 of the third sub-pixel 113 of each pixel unit 110 in an odd row is located in a pixel area of the first sub-pixel 111 in a pixel unit 110 adjacent to the pixel unit 110. The adjacent pixel unit 110 is located in a row next to the row where the pixel unit 110 is located at. For example, the active element 313 of the third sub-pixel 113 of each pixel unit 110 in the first row R1 may be provided in the pixel area of the first sub-pixel 111 in a pixel unit 110, which is adjacent to the pixel unit 110, in the second row R2, and the active element 313 of the third sub-pixel 113 of each pixel unit 110 in the third row R3 is provided in the pixel area of the first sub-pixel 111 in a pixel unit 110, which is adjacent to the pixel unit 110, in the fourth row R4, as shown in FIG. 2. However, the present invention is not limited thereto.

In addition, one of the active element 312 of the second sub-pixel 112 and the active element 313 of the third sub-pixel 113 of each pixel unit 110 in an even row is located in a pixel area of the first sub-pixel 111 in a pixel unit 110 adjacent to the pixel unit 110. The adjacent pixel unit 110 is located in a row next to the row where the pixel unit 110 is located at. For example, the active element 312 of the second sub-pixel 112 of each pixel unit 110 in the second row R2 may be provided in the pixel area of the first sub-pixel 111 in a pixel unit 110, which is adjacent to the pixel unit 110, in the third row R3, as shown in FIG. 2. However, the present invention is not limited thereto.

Therefore, in the display panel 100, except the first sub-pixel 111 of each pixel unit 110 located at the first row R1, the pixel area of the first sub-pixel 111 of each pixel unit 110 located at other rows covers two active elements 311 and 312 (or the active elements 311 and 313). In this way, the occurrence of white balance shift can be avoided.

Generally, when a white image is displayed, although a penetration rate of a conventional RGBW display panel can increase to 130% of that of a current RGB display panel, when a pure-color (that is, red, green, and blue) image is displayed, the penetration rate of the conventional RGBW decreases to 64.5% of that of the current RGB display panel. However, the penetration rate of the display panel 100 of an embodiment of the present invention can increase to 185% of that of the current RGB display panel when the display panel 100 displays a white image, and slightly decreases to 90% of that of the current RGB display panel when the display panel 100 displays a pure-color image. Based on the above, the penetration rate of the display panel 100 of an embodiment of the present invention can increase to 1.42 times that of the conventional RGBW display panel when the display panel 100 display a pure-color image, so that the problem that the pure-color image is dark can be effectively improved, and the overall luminance of the display panel 100 can be improved.

Based on the above, by means of the display control unit, the display device, and the display control method of the embodiments of the present invention, corresponding four color reformed data are generated by using a plurality of pixels as a pixel unit, and then the four color reformed data are selectively output according to whether each pixel unit is located at an odd row or an even row. In particular, a first sub-pixel of the pixel unit located at the odd row displays a first color; a first sub-pixel of the pixel unit located at the even row displays a fourth color, and the first sub-pixel of the pixel unit located at the odd row and the first sub-pixel of the pixel unit located at the adjacent even row are set diagonally. In this way, the display control unit, the display device, and the display control method of the embodiments of the present invention can improve the penetrate rate of the display panel and improve the pure-color luminance.

The technical content of the present invention is disclosed through the foregoing preferable embodiments; however, these embodiments are not intended to limit the present invention. Various changes and modifications made by persons of ordinary skill in the art without departing from the spirit and scope of the present invention shall fall within the protection scope of the present invention. The protection scope of the present invention is subject to the appended claims.

What is claimed is:

1. A display control unit, comprising:

a signal splitter, configured to split an image signal into a plurality of input signal sets, wherein each input signal set comprises a plurality of input signals corresponding to a plurality of adjacent pixels, and each of the input signals comprises a first color initial data, a second color initial data, and a third color initial data;

a signal processor, configured to generate a first color reformed data, a second color reformed data, a third color reformed data, and a fourth color reformed data respectively according to each input signal set; and a signal configurator, configured to selectively output the first color reformed data, the second color reformed data, the third color reformed data, and the fourth color reformed data corresponding to each input signal set according to locations of the plurality of pixels corresponding to each input signal set, wherein the signal configurator outputs the first color reformed data, the second color reformed data, and the third color reformed data when the plurality of pixels corresponding to the input signal set is located at an odd row, and the signal configurator outputs the second color reformed data, the third color reformed data, and the fourth color reformed data when the locations of the plurality of pixels corresponding to the input signal set is located at an even row, wherein the signal processor comprises:

a calculation module, configured to calculate a first color average according to the plurality of first color initial data of the plurality of input signals of each input signal set, calculate a second color average according to the plurality of second color initial data of the plurality of input signals of each input signal set, and calculate a third color average according to the plurality of third color initial data of the plurality of input signals of each input signal set; and a conversion module, configured to generate the first color reformed data corresponding to each input signal set according to a first weight and the first color average corresponding to each input signal set, generate the second color reformed data corresponding to each input signal set according to the first weight and the second color average corresponding to each input signal set, generate the third color reformed data corresponding to each input signal set according to the first weight and the third color average corresponding to each input signal set, and generate the fourth color reformed data corresponding to each input signal set according to a second weight and the first color average, the second color average, and the third color average corresponding to each input signal set.

2. The display control unit according to claim 1, wherein the calculation module is further configured to calculate a luminance value corresponding to each input signal of each input signal set according to the first color initial data, the second color initial data, and the third color initial data of each input signal of each input signal set, and the signal processor further comprises:

a weight generator, configured to generate the second weight according to a preset value and the luminance values corresponding to the input signals of the input signal sets.

3. The display control unit according to claim 2, wherein the weight generator is configured to generate the second weight by using a maximum value of the luminance values corresponding to the input signals of the input signal sets, and the preset value.

4. The display control unit according to claim 3, wherein the conversion module is configured to generate the fourth color reformed data by using a minimum value of the first color average, the second color average, and the third color average corresponding to each input signal set, and the second weight.

5. The display control unit according to claim 1, wherein the plurality of adjacent pixels corresponding to each input signal set is configured as a first sub-pixel, a second sub-pixel, and a third sub-pixel; the second sub-pixel is configured to display a second color having a corresponding grayscale according to the corresponding second color reformed data; the third sub-pixel is configured to display a third color having a corresponding grayscale according to the corresponding third color reformed data; the first sub-pixel in the odd row is configured to display a first color having a corresponding grayscale according to the corresponding first color reformed data, and the first sub-pixel in the even row is configured to display a fourth color having a corresponding grayscale according to the corresponding fourth color reformed data.

6. The display control unit according to claim 5, wherein the first sub-pixel of the plurality of pixels in the odd row and the first sub-pixel of the plurality of pixels in the adjacent odd row are set diagonally.

7. The display control unit according to claim 6, wherein a light-emitting area of the first sub-pixel is twice a light-emitting area of the second sub-pixel, and the light-emitting area of the second sub-pixel is same as that of the third sub-pixel.

8. A display device, comprising:

a display panel, comprising a plurality of pixel units arranged in an matrix, wherein each pixel unit is formed by a plurality of adjacent pixels that are in a same row, and each pixel unit comprises:

a first sub-pixel, wherein the first sub-pixel in an odd row is configured to display a first color having a corresponding grayscale, and the first sub-pixel in an even row is configured to display a fourth color having a corresponding grayscale;

a second sub-pixel, configured to display a second color having a corresponding grayscale; and a third sub-pixel, configured to display a third color having a corresponding grayscale;

the first sub-pixel of the pixel unit in the odd row and the first sub-pixel of the pixel unit in the adjacent even row are set diagonally;

a display control unit, configured to respectively generate a first color reformed data, a second color reformed data, a third color reformed data, and a fourth color reformed data corresponding to the pixel unit according to a plurality of input signals corresponding to the plurality of pixels in each pixel unit in an image signal; and a display drive unit, configured to drive the first sub-pixel according to the first color reformed data corresponding to each pixel unit in the odd row, drive the second sub-pixel according to the second color reformed data corresponding to each pixel unit, drive the third sub-pixel according to the third color reformed data corresponding to each pixel unit, and drive the first sub-pixel according to the fourth color reformed data corresponding to each pixel unit in the even row, wherein the display control unit comprises:

a signal splitter, configured to split the image signal into a plurality of input signals, wherein each input signal comprises a first color initial data, a second color initial data, and a third color initial data, and an input signal set is formed corresponding to the plurality of input signals of the plurality of pixels in each pixel unit;

a signal processor, configured to generate the first color reformed data, the second color reformed data, the third color reformed data, and the fourth color reformed data respectively according to each input signal set; and a signal configurator, configured to selectively output the first color reformed data, the second color reformed data, the third color reformed data, and the fourth color reformed data corresponding to each input signal set according to locations of the plurality of pixels corresponding to each input signal set, wherein the signal configurator outputs the first color reformed data, the second color reformed data, and the third color reformed data when the plurality of pixels corresponding to the input signal set is located at the odd row, and the signal configurator outputs the second color reformed data, the third color reformed data, and the fourth color reformed data when the locations of the plurality of pixels corresponding to the input signal set is located at the even row;

wherein the signal processor comprises:

a calculation module, configured to calculate a first color average according to the plurality of first color initial data of the plurality of input signals of each input signal set, calculate a second color average according to the plurality of second color initial data of the plurality of input signals of each input signal set, and calculate a third color average according to the plurality of third color initial data of the plurality of input signals of each input signal set; and a conversion module, configured to generate the first color reformed data corresponding to each input signal set according to a first weight and the first color average corresponding to each input signal set, generate the second color reformed data corresponding to each input signal set according to the first weight and the second color average corresponding to each input signal set, generate the third color reformed data corresponding to each input signal set according to the first weight and the third color average corresponding to each input signal set, and generate the fourth color reformed data corresponding to each input signal set according to a second weight and the first color average, the second color average, and the third color average corresponding to each input signal set.

9. The display device according to claim 8, wherein a light-emitting area of the first sub-pixel is twice a light-emitting area of the second sub-pixel, and the light-emitting area of the third sub-pixel is same as that of the second sub-pixel.

10. The display device according to claim 8, wherein the display drive unit comprises a plurality of active elements corresponding to the first sub-pixel, the second sub-pixel, and the third sub-pixel of the plurality of pixel units; wherein the active element corresponding to the third sub-pixel of each pixel unit in the odd row is located in a pixel area of the first sub-pixel of each pixel unit in the adjacent even row, and the active element corresponding to the second sub-pixel of each pixel unit in the even row is located in a pixel area of the first sub-pixel of each pixel unit in the adjacent odd row.

11. The display device according to claim 8, wherein the calculation module is further configured to calculate a luminance value corresponding to each input signal of each input signal set according to the first color initial data, the second color initial data, and the third color initial data of each input signal of each input signal set, and the signal processor further comprises:

a weight generator, configured to generate the second weight according to a preset value and the luminance values corresponding to the input signals of the input signal sets.

12. The display device according to claim 11, wherein the weight generator is configured to generate the second weight by using a maximum value of the luminance values corresponding to the input signals of the input signal sets, and the preset value.

13. The display device according to claim 12, wherein the conversion module is configured to generate the fourth color reformed data by using a minimum value of the first color average, the second color average, and the third color average corresponding to each input signal set, and the second weight.

14. A display control method, comprising:

splitting an image signal into a plurality of input signal sets, wherein each input signal set comprises a plurality of input signals corresponding to a plurality of adjacent pixels, and each of the input signals comprises a first color initial data, a second color initial data, and a third color initial data;

generating a first color reformed data, a second color reformed data, a third color reformed data, and a fourth color reformed data according to each input signal set respectively; and selectively outputting the first color reformed data, the second color reformed data, the third color reformed data, and the fourth color reformed data corresponding to each input signal set according to locations of the plurality of pixels corresponding to each input signal set;

outputting the first color reformed data, the second color reformed data, and the third color reformed data when the plurality of pixels corresponding to the input signal set is located at an odd row; and outputting the second color reformed data, the third color reformed data, and the fourth color reformed data when the plurality of adjacent pixels corresponding to the input signal set is located at an even row, wherein the generation step comprises:

calculating a first color average according to the plurality of first color initial data of the plurality of input signals of each input signal set;

calculating a second color average according to the plurality of second color initial data of the plurality of input signals of each input signal set;

calculating a third color average according to the plurality of third color initial data of the plurality of input signals of each input signal set;

generating the first color reformed data corresponding to each input signal set according to a first weight and the first color average corresponding to each input signal set;

generating the second color reformed data corresponding to each input signal set according to the first weight and the second color average corresponding to each input signal set;

generating the third color reformed data corresponding to each input signal set according to the first weight and the third color average corresponding to each input signal set; and generating the fourth color reformed data corresponding to each input signal set according to a second weight and the first color average, the second color average, and the third color average corresponding to each input signal set.

15. The display control method according to claim 14, wherein the generation step further comprises:

calculating a luminance value corresponding to each input signal of each input signal set according to the first color initial data, the second color initial data, and the third color initial data of each input signal of each input signal set, and generating the second weight according to a preset value and the luminance values corresponding to the input signals of the input signal sets.

16. The display control method according to claim 15, wherein the step of generating the second weight according to the preset value and the luminance values corresponding to the input signals of the input signal sets comprises generating the second weight by using a maximum value of the luminance values corresponding to the input signals of the input signal sets, and the preset value.

17. The display control method according to claim 16, wherein the step of generating the fourth color reformed data corresponding to each input signal set according to the second weight and the first color average, the second color average, and the third color average corresponding to each input signal set comprises generating the fourth color reformed data by using a minimum value of the first color average, the second color average, and the third color average corresponding to each input signal set and the second weight.

18. The display control method according to claim 14, wherein the plurality of adjacent pixels corresponding to each input signal set is configured as a first sub-pixel, a second sub-pixel, and a third sub-pixel; the second sub-pixel is configured to display a second color having a corresponding grayscale according to the corresponding second color reformed data; the third sub-pixel is configured to display a third color having a corresponding grayscale according to the corresponding third color reformed data; the first sub-pixel in the odd row is configured to display a first color having a corresponding grayscale according to the corresponding first color reformed data, and the first sub-pixel in the even row is configured to display a fourth color having a corresponding grayscale according to the corresponding fourth color reformed data.

19. The display control method according to claim 18, wherein the first sub-pixel of the plurality of pixels in the odd row and the first sub-pixel of the plurality of pixels in the adjacent odd row are set diagonally.

20. The display control method according to claim 19, wherein a light-emitting area of the first sub-pixel is twice a light-emitting area of the second sub-pixel, and the light-emitting area of the second sub-pixel is same as that of the third sub-pixel.

* * * * *